US006397974B1

(12) United States Patent
Adifon et al.

(10) Patent No.: US 6,397,974 B1
(45) **Date of Patent: *Jun. 4, 2002**

(54) TRACTION ELEVATOR SYSTEM USING FLEXIBLE, FLAT ROPE AND A PERMANENT MAGNET MACHINE

(75) Inventors: Leandre Adifon; Pedro S. Baranda, both of Farmington, CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/169,415

(22) Filed: Oct. 9, 1998

(51) Int. Cl.[7] ..... B66B 11/08; B66B 11/04

(52) U.S. Cl. ..... 187/254; 187/266; 254/902; 310/156; 310/261

(58) Field of Search ..... 187/254, 250, 187/256, 258, 266, 411, 414; 254/902; 310/156, 261

(56) References Cited

U.S. PATENT DOCUMENTS

| | | | | | |
|---|---|---|---|---|---|
| 975,790 | A | * | 11/1910 | Pearson | 187/254 |
| 1,029,627 | A | * | 6/1912 | Pearson | 187/258 |
| 3,101,130 | A | * | 8/1963 | Bianca | 187/256 |
| 3,909,647 | A | * | 9/1975 | Peterson | 310/156 |
| 4,570,753 | A | | 2/1986 | Ohta et al. | |
| 4,624,097 | A | * | 11/1986 | Wilcox | 57/232 |
| 4,739,969 | A | | 4/1988 | Eckersley et al. | 254/378 |
| 4,960,186 | A | | 10/1990 | Honda | |
| 5,018,603 | A | | 5/1991 | Ito | 187/17 |
| 5,429,211 | A | | 7/1995 | Aulanko et al. | 187/254 |
| 5,490,578 | A | * | 2/1996 | Aulanko et al. | 187/254 |
| 5,566,786 | A | | 10/1996 | De Angelis et al. | |
| 5,665,944 | A | | 9/1997 | Aulanko et al. | 187/277 |
| 5,834,942 | A | * | 11/1998 | De Angelis | 187/226 X |
| 5,881,843 | A | * | 3/1999 | O'Donnell et al. | 187/254 |
| 6,006,865 | A | * | 12/1999 | Ammon | 187/266 |

FOREIGN PATENT DOCUMENTS

| | | | | |
|---|---|---|---|---|
| CA | 2127873 | | | 7/1993 |
| DE | 2307104 | | | 8/1973 |
| EP | 676357 | A2 | | 10/1995 |
| EP | 0688735 | | | 12/1995 |
| GB | 1401197 | | | 7/1975 |
| GB | 2134209 | A | * | 8/1984 |
| GB | 2162283 | A | * | 1/1986 |
| JP | 7-213633 | A | * | 8/1995 |
| JP | 8-289517 | A | * | 11/1996 |
| WO | WO9500432 | | | 1/1995 |
| WO | WO9528028 | | | 10/1995 |
| WO | WO9829326 | | | 7/1998 |
| WO | WO9829327 | | | 7/1998 |

OTHER PUBLICATIONS

Article entitled "Hannover Fair: Another new idea from ContiTech—Lifting belts for elevators"; reprint date Jan. 1998.

* cited by examiner

*Primary Examiner*—Dean J. Kramer
*Assistant Examiner*—Thuy V. Tran

(57) ABSTRACT

A traction elevator system includes a machine having a rotor including permanent magnets and a flat rope engaged with the machine. The flat rope includes one or more load-carrying members retained within a common sheath from a non-metallic material.

22 Claims, 4 Drawing Sheets

TRACTION ELEVATOR SYSTEM USING FLEXIBLE, FLAT ROPE AND A PERMANENT MAGNET MACHINE

TECHNICAL FIELD

The present invention relates to elevator systems, and more particularly to elevator systems that use machines with rotors having permanent magnets.

BACKGROUND OF THE INVENTION

A typical traction elevator system includes a car and a counterweight disposed in a hoistway, a plurality of ropes that interconnect the car and counterweight, and a machine having a traction sheave engaged with the ropes. The ropes, and thereby the car and counterweight, are driven by rotation of the traction sheave. The machine, and its associated electronic equipment, along with peripheral elevator components, such as a governor, are housed in a machineroom located above the hoistway.

A recent trend in the elevator industry is to eliminate the machineroom and locate the various elevator equipment and components in the hoistway. An example is JP 4-50297, which discloses the use of a machine located between the car travel space and a wall of the hoistway. Another example is U.S. Pat. No. 5,429,211, which discloses the use of a machine located in the same position but having a motor with a disc-type rotor. This configuration makes use of the flatness of such a machine to minimize the space needed for the machine in the hoistway. This machine disclosed also makes use of permanent magnets in the rotor in order to improve the efficiency of the machine. These types of machines, however, are limited to relatively low duties and low speeds.

One possible solution to apply such machines to higher duty load elevator systems or higher speed systems is to increase the diameter of the rotor. This solution is not practical, however, due to the space constraints of the hoistway. Another solution, disclosed in PCT Application PCT/FI98/00056, is to use a machine with two motors and a traction sheave sandwiched between the two motors. This solution, however, also exceeds the space limitations of the hoistway and requires the provision of a separate machineroom above the hoistway to house the machine.

The above art notwithstanding, scientists and engineers under the direction of Applicants' Assignee are working to develop elevator systems that efficiently utilize the available space and meet the duty load and speed requirements over a broad range of elevator applications.

DISCLOSURE OF THE INVENTION

According to the present invention, an elevator system includes a machine having a rotor including permanent magnets and a flat rope engaged with the machine.

Flat rope, as used herein, is defined to include ropes having an aspect ratio, defined as the ratio of width w relative to thickness t, substantially greater than one. A more detailed description of an example of such ropes is included in commonly owned co-pending U.S. patent application Ser. No. 09/031,108, entitled "Tension Member for an Elevator", filed Feb. 2, 1998, which is incorporated herein by reference.

An advantage of the present invention is the size of the machine required to meet duty load and speed requirements. The combination of the improved efficiency of the machine and the torque reduction provided by the flat rope result in a very compact machine that can be fit within the space constraints of a hoistway without adversely affecting the performance of the elevator system. This permits the machine to be located in positions that were previously inpractical.

Another advantage is a reduction in the energy consumption of the elevator system using the present invention. The flat rope results in an engagement surface, defined by the width dimension, that is optimized to distribute the rope pressure. Therefore, the maximum pressure is minimized within the rope. In addition, by increasing the aspect ratio relative to a round rope, which has an aspect ratio substantially equal to one, the thickness of the rope may be reduced while maintaining a constant cross-sectional area of the rope. Minimizing the thickness of the rope results in a smaller diameter traction sheave, which in turn reduces the torque on the machine decreases the size of the motor and may eliminate the need for gearing. In addition, the smaller diameter of the sheave results in an increased rotational speed of the motor, which further increases the efficiency of the machine.

In a particular embodiment, the permanent magnet machine is combined with a flat rope that includes a plurality of load-carrying members and a sheath that surrounds the load-carrying members and is formed from polyurethane. In one configuration, the load-carrying members are formed from an aramid material that produces a high strength, lightweight rope with enhanced flexibility, as compared to conventional round steel ropes. In another configuration, the load-carrying members are steel cords formed from very thin wires, with the wires having diameter of 0.25 mm or less. The use of a sheath formed from polyurethane permits the outer surface of the rope to be optimized for traction.

An advantage of this particular embodiment is the minimal risk of heat damage to the sheath and the load-carrying members of the rope due to use of a machine having a rotor with permanent magnets. In a conventional induction motor, much of the heat losses are in the rotor. This heat loss is conducted directly to the ropes through the sheave. For ropes formed from materials other than steel, which are more temperature sensitive, exposure to such a heat source may lead to degradation of the rope. By using a machine having a rotor with permanent magnets, however, the principle source of heat loss is through the stator and not through the rotor. Therefore, since there is no direct path between the stator and the ropes, the ropes are not exposed to the primary source of heat and the risk of heat related degradation of the materials of the rope is minimized. In addition, the increased efficiency of the permanent magnet machine reduces the total heat generated and therefore further reduces the heating of the ropes.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
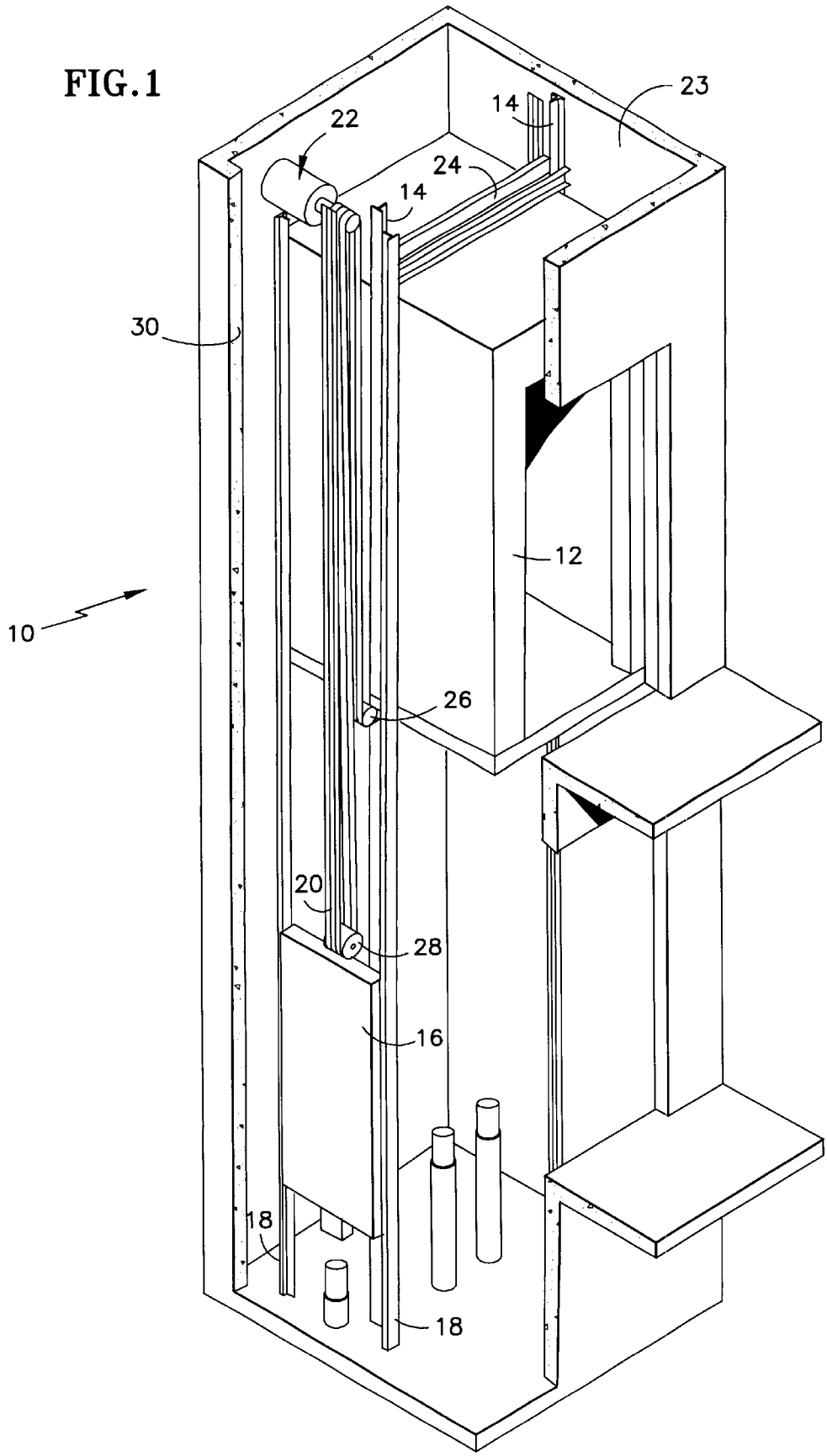
FIG. 1 is a perspective view of an elevator system according to the present invention.

Illustrated in FIG. 1 is an elevator system 10 according to the present invention. The elevator system 10 includes a car 12, a pair of car guide rails 14, a counterweight 16, a pair of counterweight guide rails 18, a plurality of ropes 20 interconnecting the car 12 and counterweight, and a traction machine 22 engaged with the ropes 20. The car 12 and counterweight 16 are interconnected to move concurrently and in opposite directions within a hoistway 23.

The car 12 includes a frame 24 and a pair of diverter sheaves 26 (only one of which is shown in FIG. 1) disposed on opposite sides of the underside of the car frame 24. The diverter sheaves 26 define an engagement means between the car 12 and ropes 20 and permit the ropes 20 to pass underneath the car 12 such that the car 12 is underslung.

The counterweight 16 includes a diverter sheave 28 disposed on the top of the counterweight 16. This diverter sheave 28 defines an engagement means between the counterweight 16 and ropes 20. As a result of the roping arrangement shown in FIG. 1, both the car 12 and counterweight 16 are roped in a 2:1 arrangement relative to the machine 22.

The machine 22 is located between the travel path of the car 12 and a wall 30 of the hoistway 23. The machine 22 is illustrated in more detail in FIG. 3. The machine 22 includes a motor 32 having a shaft 34 and a traction sheave 36. The motor 32 includes a frame 38, bearings 40, a stator 42 and a rotor 44. The traction sheave 36 is disposed on the end of the shaft 34 and defines an engagement surface 46 for the ropes 20. The rotor 44 is disposed in a fixed relationship to the shaft 34 and includes a plurality of permanent magnets 48 disposed radially inward of the stator 42 such that a radial air gap 50 is defined between the rotor 44 and stator 42. The use of permanent magnets 48 increases the efficiency and minimizes the size of the motor 32.

Figure 3:
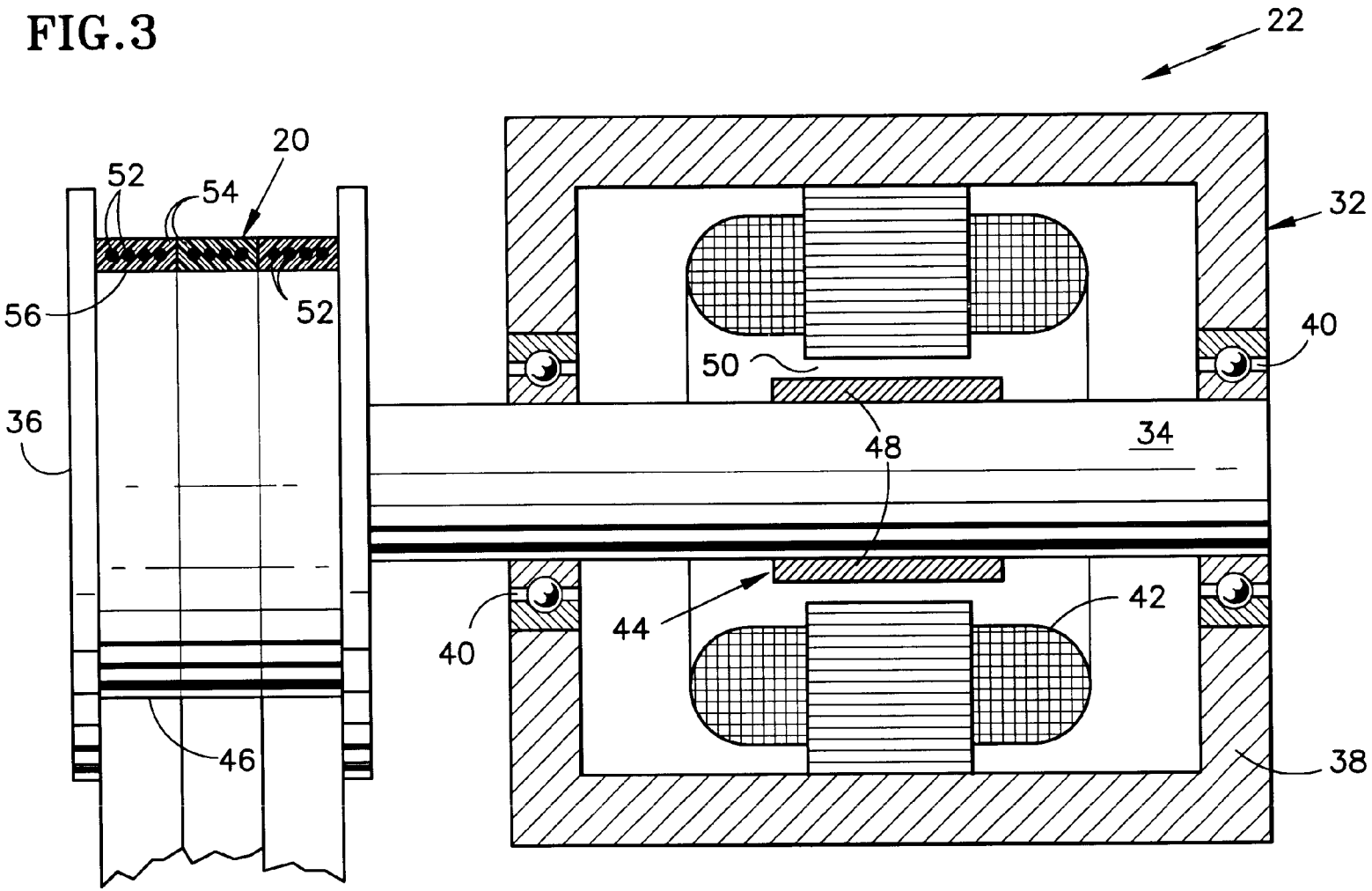
FIG. 3 is a sectioned side view of a machine and ropes used in the embodiments of FIGS. 1 and 2.

The ropes 20 interconnecting the car 12 and counterweight 16 are flexible flat ropes. As shown in FIG. 3, there are three separate flat ropes 20 engaged with the machine 22. Each flat rope 20 includes a plurality of load-carrying members 52 encompassed by a sheath 54. The plurality of load-carrying members 52 support the tension loads in the ropes 20. The sheath 54 provides a retention layer for the load-carrying members 52 while also defining an engagement surface 56 for the flat rope 20. Traction between the flat rope 20 and the machine 22 is the result of the interaction between the engagement surface 56 of the ropes 20 and the complementary engagement surface 46 of the machine 22. Although shown in FIG. 3 as having three flat ropes 20, each having four load-carrying members 52, it should be noted that different numbers of flat ropes and different numbers of load-carrying members within each rope may be used, such as an embodiment having a single flat rope or a flat rope having a single load-carrying member.

A suggested material for the load-carrying members is an aramid material, such as that sold by DuPont under the name of KEVLAR. Such materials provide the advantages of having high tensile strength and being lightweight relative to conventional materials, such as steel. As an alternative, the load-carrying member may be formed from steel cord. In order to provide sufficient flexibility in the rope, it is suggested to form the cord from steel wires or fibers having diameters of 0.025 mm or less.

A suggested material for the sheath is polyurethane. Polyurethane provides the durability required while also enhancing the traction between the flat rope and the machine. Although this material is suggested, other materials may also be used. For instance, a sheath formed from neoprene or rubber may be used.

The use of flexible, flat ropes 20 minimizes the size of the traction sheave 36 and thereby minimizes the torque on the motor 32 and increases the rotational speed of the motor 32. By combining these characteristics of the flat ropes 20 with the characteristics of the permanent magnet machine 22, the motor 32 size is further reduced and the machine 22 can be fit within the space available between the car 12 and hoistway wall 30. Another advantage is that the higher rotational speeds further increases the efficiency of the motor 32 and may eliminate the need for a gear box.

The use of a rotor 44 having permanent magnets 48 also reduces the amount of heat loss through the rotor 44 as compared to conventional induction motors. As shown in FIG. 3, the rotor 44, traction sheave 36 and ropes 20 are in direct contact. This direct contact results in heat generated in the rotor 44 being conducted to the ropes 20. For conventional induction motors, the rotor accounts for approximately one-third of the heat loss. However, for rotors using permanent magnets, the heat loss through the rotor is minimal and the primary source of heat loss in such motors is through the stator. As shown in FIG. 3, in embodiments according to the present invention there is no direct path between the stator 42 and the ropes 20. Therefore, the effects on the ropes 20 of the heat loss of the motor 22 is minimized. This is especially significant for ropes having a sheath formed from non-metallic materials, such as polyurethane, that are more susceptible to heat degradation than steel.

Figure 2:
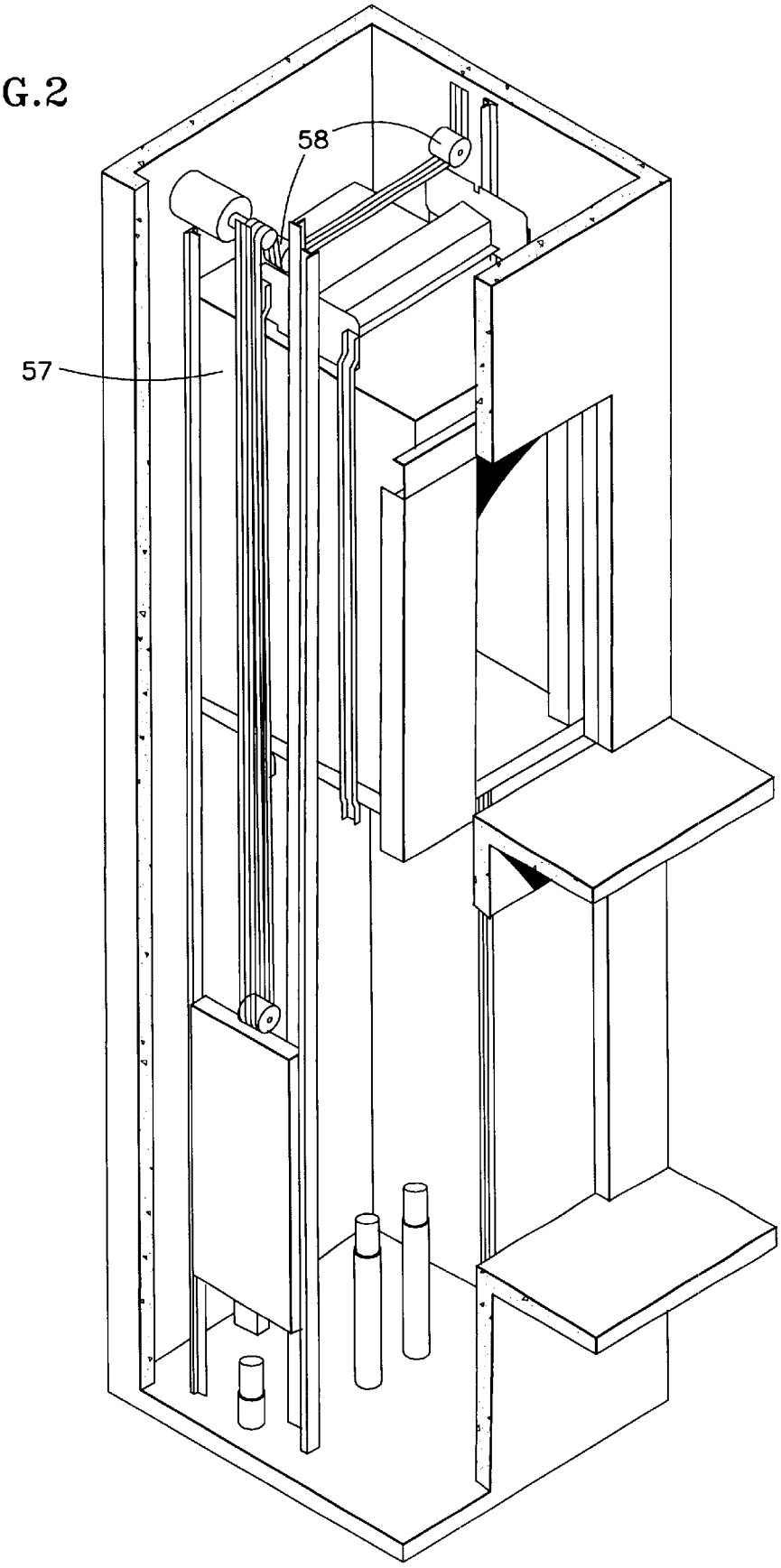
FIG. 2 is a perspective view of an alternate embodiment of the present invention.

The elevator system 10 illustrated in FIG. 1 includes an underslung car 12. FIG. 2 illustrates another embodiment. In this embodiment, a car 57 includes a pair of diverter sheaves 58 located on the top of the car 57 in a manner known as overslung. In conventional elevator systems, overslung roping arrangements are less desirable in some applications due to the need to provide additional overhead space for the elevator system. This is especially significant if the machine is located in the hoistway. In the configuration shown in FIG. 2, however, the effects of an overslung car 57 are minimized as a result of the small machine and small sheaves that may be used with the present invention. Therefore, an overslung car 57 using Applicants' invention requires less overhead space and is more practical.

In another alternative (not shown), the car may be directly roped to the machine such that no sheaves are required on the car. In addition, although it is not illustrated, the machine may be located above the car travel path. Although in this particular embodiment an allowance will have to be made for the space required in the overhead for the machine, the combination of a permanent magnet machine and flexible flat ropes will minimize this space allowance.

Figure 4:
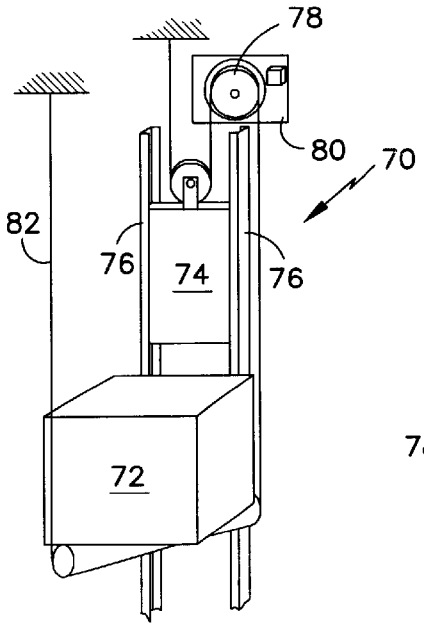
FIG. 4 is an illustration of another embodiment of the present invention.
Figure 5:
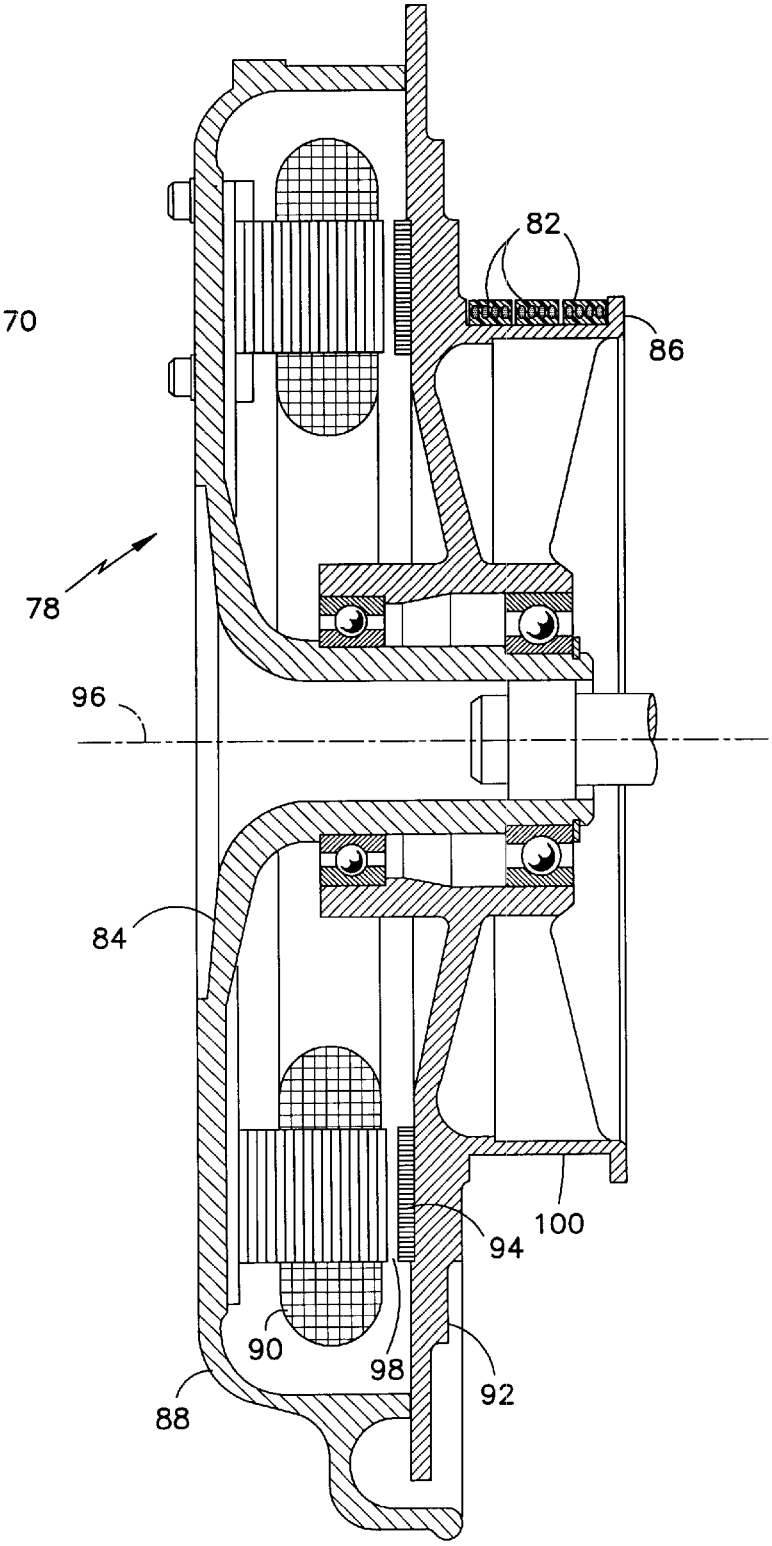
FIG. 5 is a sectioned top view of a machine used in the embodiment of FIG. 4.

Although illustrated in FIGS. 1–3 as an elevator system having a cylindrically shaped machine having a radially oriented air gap, other types of machines may also be used with the present invention. One such embodiment is illustrated in FIGS. 4 and 5. In this embodiment, the elevator system 70 includes a car 72, a counterweight 74, a pair of guide rails 76 for the car 72 and counterweight 74, a machine 78 disposed between the car 72 and a wall 80 of the hoistway, and a plurality of flat ropes 82 interconnecting the car 72 and counterweight 74.

The machine 78 and ropes 82 are illustrated in more detail in FIG. 5. The machine 78 includes a motor 84 and a traction sheave 86. The motor 84 includes a frame 88, a stator 90 and a rotor 92. The rotor 92 is a disc-type rotor 92 that produces a relatively flat machine 78. A plurality of permanent magnets 94 are circumferentially spaced about the axis 96 of the machine 78 and axially spaced from the stator 90 such that an axial air gap 98 between the rotor 92 and stator 90 is defined. The traction sheave 86 is integral to the rotor 92 and includes an engagement surface 100 for the plurality of ropes 82. The plurality of ropes 82 are similar to those described with respect to the embodiment of FIGS. 1–3.

The embodiment of FIGS. 4 and 5 has the same advantages as discussed previously for the embodiment of FIGS. 1–3. In addition, the application of flat ropes 82 to the disc-type machine 78 of FIG. 5 will result in minimizing the diameter of the rotor 92 and stator 90, thereby making this configuration applicable to a wider range of elevator applications.

The embodiments illustrated in FIGS. 1–5 were all elevator systems having gearless machines. Although the invention is particularly advantageous in that it extends the range of usefulness of gearless machines, it should be noted that the invention may also be used with geared machines in particular applications. In addition, although shown in FIG. 3 as having a rotor radially inward of the stator, it should be apparent to those skilled in the art that the relative positions of the rotor and stator may be switched.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator system having a car disposed within a hoistway and a counterweight, the elevator system including:

a rope interconnecting the car and the counterweight, the rope including a load-carrying member and a sheath formed of a non-metallic material encasing the load-carrying member, the rope having a width w, a thickness t measured in the bending direction, and an aspect ratio, defined as the ratio of width w relative to thickness t, greater than one; and a machine having a traction sheave engaged with the sheath of the rope to drive the rope through traction transmitted from the traction sheave through the sheath to the load-carrying member of the rope, and thereby drive the car through the hoistway, wherein the machine includes a rotor driving the traction sheave and formed in part from permanent magnets.

2. The elevator system according to claim 1, wherein the rope is engaged with a sheave disposed on the top of the car.

3. The elevator system according to claim 1, wherein the sheath is formed from polyurethane.

4. The elevator system according to claim 1, wherein the rope includes one or more of the load-carrying members formed from a non-metallic material.

5. The elevator system according to claim 4, wherein the load-carrying members are formed from an aramid material.

6. The elevator system according to claim 1, wherein the rope includes one or more load-carrying members formed from steel.

7. The elevator system according to claim 6, wherein the load-carrying members are formed from steel wires having diameters of 0.25 mm or less.

8. The elevator system according to claim 1, wherein the rotor is cylindrically shaped.

9. The elevator system according to claim 1, wherein the rotor is flat.

10. The elevator system according to claim 1, wherein the machine includes a motor having the rotor and a stator, and further including an air gap between the rotor and stator, and wherein the rotor is axially spaced from the stator.

11. The elevator system according to claim 1, wherein the machine includes a motor having the rotor and a stator, and further including an air gap between the rotor and stator, and wherein the rotor is radially spaced from the stator.

12. The elevator system according to claim 11, wherein the rotor is spaced radially inward of the stator.

13. The elevator system according to claim 1, wherein the machine is gearless.

14. The elevator system according to claim 1, wherein the load-carrying member of the rope includes a plurality of individual load carrying ropes encased within the sheath, and wherein the sheath defines an engagement surface for engaging the traction sheave.

15. The elevator system according to claim 1, wherein the machine is disposed between the travel space of the car and a wall of the hoistway.

16. The elevator system according to claim 1, wherein the rope is engaged with a pair of sheaves disposed on the car such that the rope passes underneath the car.

17. An elevator system having a car disposed within a hoistway and a counterweight, the elevator system including:

a rope interconnecting the car and the counterweight, the rope including a load-carrying member and a sheath encasing the load-carrying member, wherein the sheath is formed from a non-metallic material, the rope having a width w, a thickness t measured in the bending direction, and an aspect ratio, defined as the ratio of width w relative to thickness t, greater than one; and a machine including a traction sheave and a rotor, the traction sheave being directly connected with the rotor for concurrent rotation and engaged with the sheath of the rope to drive the rope through traction transmitted from the traction sheave through the sheath to the load-carrying member of the rope, and thereby drive the car through the hoistway, wherein the rotor is formed in part from permanent magnets.

18. The elevator system according to claim 17, wherein the sheath is formed from a polyurethane material.

19. The elevator system according to claim 17, further including one or more of the load-carrying members, wherein the load-carrying members are formed from a non-metallic material.

20. The elevator system according to claim 19, wherein the load-carrying members are formed from aramid material.

21. The elevator system according to claim 17, further including one or more load-carrying members, wherein the load-carrying members are formed from steel.

22. The elevator system according to claim 21, wherein the load-carrying members are formed from steel wires having a diameter of 0.25 mm or less.

* * * * *

US006397974C1

(12) EX PARTE REEXAMINATION CERTIFICATE (8408th)

United States Patent

Adifon et al.

(10) Number: US 6,397,974 C1

(45) Certificate Issued: Jul. 19, 2011

(54) TRACTION ELEVATOR SYSTEM USING FLEXIBLE, FLAT ROPE AND A PERMANENT MAGNET MACHINE

(75) Inventors: Leandre Adifon, Farmington, CT (US); Pedro S. Baranda, Farmington, CT (US)

(73) Assignee: Otis Elevator Company, Farmington, CT (US)

Reexamination Request:
No. 90/011,059, Jul. 14, 2010

Reexamination Certificate for:

| | |
|---|---|
| Patent No.: | **6,397,974** |
| Issued: | **Jun. 4, 2002** |
| Appl. No.: | **09/169,415** |
| Filed: | **Oct. 9, 1998** |

(51) Int. Cl.
*B66B 11/08* (2006.01)
*B66B 11/04* (2006.01)

(52) U.S. Cl. ..... 187/254; 187/266; 187/902; 187/261.1

(58) Field of Classification Search ..... 187/254
See application file for complete search history.

(56) References Cited

U.S. PATENT DOCUMENTS

| | | | |
|---|---|---|---|
| 3,737,747 | A | 6/1973 | Krauer |
| 4,739,969 | A | 4/1988 | Eckersley et al. |
| 4,877,060 | A | 10/1989 | Froment et al. |
| 4,916,368 | A | 4/1990 | Onoda et al. |
| 5,461,850 | A | 10/1995 | Bruyneel et al. |
| 5,566,786 | A | 10/1996 | De Angelis et al. |
| 5,783,895 | A | 7/1998 | Hakala et al. |

FOREIGN PATENT DOCUMENTS

| | | | |
|---|---|---|---|
| CA | 2220582 | | 5/1998 |
| DE | 6338 | | 7/1879 |
| DE | 195008 | | 3/1907 |
| DE | 2 307 107 | | 2/1973 |
| DE | 23 07 104 | C2 | 8/1973 |
| DE | 2851595 | C2 | 11/1979 |
| DE | 694 17 104 | T2 | 6/1993 |
| DE | 694 20 329 | T2 | 6/1993 |
| DE | 699 14 577 | T3 | 5/2009 |
| EP | 0 631 970 | A2 | 6/1994 |
| EP | 0 676 357 | A2 | 3/1995 |
| EP | 0 688 735 | A2 | 6/1995 |
| EP | 0 688 735 | | 6/1995 |
| EP | 0 688 735 | A2 | 12/1995 |
| EP | 0 841 283 | A1 | 10/1997 |
| EP | 1 023 236 | B1 | 2/1999 |
| GB | 2 134 209 | A | 12/1983 |
| GB | 2 162 283 | A | 1/1986 |
| JP | 07117957 | | 5/1995 |
| JP | 07117957 | A | 9/1995 |
| JP | 09021084 | A | 1/1997 |
| JP | 09142761 | | 3/1997 |
| JP | 09142761 | | 6/1997 |
| JP | 9-142761 | | 6/1997 |
| JP | 10017245 | | 1/1998 |
| JP | 10152274 | | 6/1998 |
| JP | 10-257734 | A | 9/1998 |
| JP | 10257734 | | 9/1998 |
| WO | 98/29326 | | 7/1998 |
| WO | 98/32685 | | 7/1998 |
| WO | 99/43590 | | 9/1999 |
| WO | 99/43602 | | 9/1999 |

OTHER PUBLICATIONS

"Hannover Fair: Another new idea from ContiTech–Lifting belts for elevators," Hannover Fair 1998, Apr. 20–25, 1998 (K22) w/English Translation.

J. R. Hendershot and Tje Miller, "Design of Brushless Permanent–Magnet Motors," pp. 2.1–2.15 and 3.1–3.3, 1994 (K23).

European Standard, Safety rules for the construction and installation of lifts, Feb. 1998, English Version (K2).

(Continued)

*Primary Examiner*—William C Doerrler

(57) ABSTRACT

A traction elevator system includes a machine having a rotor including permanent magnets and a flat rope engaged with the machine. The flat rope includes one or more load-carrying members retained within a common sheath from a non-metallic material.

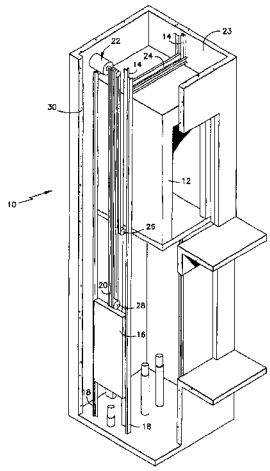

OTHER PUBLICATIONS

Lift Report, Sep./Oct. 1998, pp. 3, 44, 46, 48–52, 148 (K35).
Lift–Report, May/Jun. 1998, pp. 3, 46–48, 50, 52–54, 56, 58–60, 120 (K36).
Tractielift Zonder Machinekramer, BouwWereld nr. 19, Oct. 11, 1996, pp. 67 and 68 (K27) w/German Translation (K27A).
Elevator World, Jan. 1997, p. 99 (K37).
German Industrial Standard DIN 2078, 1990, pp. 14–18 (K38).
Eckersley, "New Concepts in Elevator Drive Systems—Incorporating Synchronous AC Gearless Machines with Variable Frequency Control," Lift–Report, Sep./Oct. 1991.
Megadyne Open End Belts Oct. 1, 2006.
Hendershot and Miller, "Design of Brushless Permanent–Magnet Motors," pp. 1.1, 15.2, and 15.3, 1994.
Permanent Mangent Motor drives referenced as D4 in the Translation of Opposition Brief against EP 1023236 B1 in European Application No. 99 936 066.2.
Deutsche Fassung referenced as D11 in the Translation of Opposition Brief against EP 1023236 B1 in European Application No. 99 936 066.2.
Tractielift zonder machinekamer referenced as D14 in the Translation of Opposition Brief against EP 1023236 B1 in European Application No. 99 936 066.2.
Ciosk et al., "Analysis of Electromagnetic Field in a Disk Induction Motor with Double–Sided Stator and Twin Rotors Using a 3–D Reluctance Network Method," International Conference on Electrical Machines, vol. 1/3, Sep. 2–4, 1998, Istanbul, Turkey, pp. 286–289.
Wiak et al., "Electromagnetic Field Analysis of 3D structure of Disk–type induction motor," International Conference on Electrical Machines, vol. 1/3, Sep. 2–4, 1998, Istanbul, Turkey, pp. 375–739.
Engleman and Middendorf, "Handbook of Electric Motors," 1994, Marcel Dekker publishing, pp. 125 and 126.
The Vertical Transportation Handbook; Third Edition; Author: George R. Strakosch; Copyright 1998; Publisher: John Wiley & Sons, Inc.; 6 pages.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 8-11 are cancelled.

Claims 1, 4, 6, 12, 17, 19 and 21 are determined to be patentable as amended.

Claims 2, 3, 5, 7, 13-16, 18, 20 and 22, dependent on an amended claim, are determined to be patentable.

New claims 23-41 are added and determined to be patentable.

1. An elevator system having a car disposed within a hoistway and a counterweight, the elevator system including:

a rope interconnecting the car and the counterweight, the rope including [a] load-carrying [member] *members* and a sheath formed of a non-metallic material encasing the load-carrying [member] *members*, the rope having a width w, a thickness t measured in the bending direction, and an aspect ratio, defined as the ratio of width w relative to thickness t, greater than one; and a machine having a *motor, a shaft extending from the motor, and a* traction sheave *disposed on the shaft, wherein the motor comprises:*

*a stator;*

*a cylindrical-type rotor spaced from the stator and driving the shaft; and*

*a radial air gap between the stator and rotor;*

*wherein the traction sheave is* engaged with the sheath of the rope to drive the rope through traction transmitted from the traction sheave through the sheath to the load-carrying [member] *members* of the rope, and thereby drive the car through the hoistway, wherein the [machine includes a] rotor driving the traction sheave and formed in part from permanent magnets.

4. The elevator system according to claim 1, wherein [the rope includes] one or more of the load-carrying members *are* formed from a non-metallic material.

6. The elevator system according to claim 1, wherein the [rope includes] one or more *of the* load-carrying members *are* formed from steel.

12. The elevator system according to claim [11] *1*, wherein the rotor is spaced radially inward of the stator.

17. An elevator system having a car disposed within a hoistway and a counterweight, the elevator system including:

a rope interconnecting the car and the counterweight, the rope including [a] load-carrying [member] *members* and a sheath encasing the load-carrying [member] *members*, wherein the sheath is formed from a non-metallic material, the rope having a width w, a thickness t measured in the bending direction, and an aspect ratio, defined as the ratio of width w relative to thickness t, greater than one; and a machine including a *motor, a shaft extending from the motor, and a* traction sheave [and a rotor,] *disposed on the shaft, wherein the motor comprises:*

*a stator;*

*a cylindrical-type rotor spaced from the stator and driving the shaft; and*

*a radial air gap between the stator and rotor;* the traction sheave being directly connected with the rotor for concurrent rotation and engaged with the sheath of the rope to drive the rope through traction transmitted from the traction sheave through the sheath to the load-carrying [member] *members* of the rope, and thereby drive the car through the hoistway, wherein the rotor is formed in part from permanent magnets.

19. The elevator system acccording to claim 17, further including one or more of the load-carrying members[, wherein the load-carrying members are] formed from a non-metallic material.

21. The elevator system according to claim 17, further including one or more load-carrying members[, wherein the load carrying-members are] formed from steel.

*23. The elevator system according to claim 1, wherein the load-carrying members are arranged side by side.*

*24. The elevator system according to claim 17, wherein the load-carrying members are arranged side by side.*

*25. The elevator system according to claim 1, wherein the shaft spaces the sheave away from the motor.*

*26. The elevator system according to claim 17, wherein the shaft spaces the sheave away from the motor.*

*27. The elevator system according to claim 25, wherein the motor includes a frame and the shaft extends from the motor frame.*

*28. The elevator system according to claim 26, wherein the motor includes a frame and the shaft extends from the motor frame.*

*29. The elevator system according to claim 1, wherein the machine includes a bearing between the motor and the sheave.*

*30. The elevator system according to claim 17, wherein the machine includes a bearing between the motor and the sheave.*

*31. The elevator system according to claim 29, wherein the rope includes a plurality of ropes and the sheave has a section for each rope.*

*32. The elevator system according to claim 30, wherein the rope includes a plurality of ropes and the sheave has a section for each rope.*

*33. The elevator system according to claim 31, wherein the bearing is between the motor and all sections of the sheave.*

*34. The elevator system according to claim 32, wherein the bearing is between the motor and all sections of the sheave.*

*35. The elevator system according to claim 17, wherein the rope is engaged with a sheave disposed on the top of the car.*

*36. The elevator system according to claim 17, wherein the machine is gearless.*

*37. The elevator system according to claim 17, wherein the load-carrying member of the rope includes a plurality of*

*individual load carrying ropes encased within the sheath, and wherein the sheath defines an engagement surface for engaging the traction sheave.*

*38. The elevator system according to claim 17, wherein the machine is disposed between the travel space of the car and a wall of the hoistway.*

*39. The elevator system according to claim 17, wherein the rope is engaged with a pair of sheaves disposed on the car such that the rope passes underneath the car.*

*40. The elevator system according to claim 1, wherein the shaft extends from the motor generally horizontally relative to the hoistway.*

*41. The elevator system according to claim 17, wherein the shaft extends from the motor generally horizontally relative to the hoistway.*

* * * * *